United States Patent [19]

Ruth

[11] Patent Number: 4,641,837

[45] Date of Patent: Feb. 10, 1987

[54] WEIGHT LIFTING BENCH WITH ADJUSTABLE BENCH SECTIONS

[76] Inventor: Bruce M. Ruth, R.D. 6, Box 230, Reading, Pa. 19608

[21] Appl. No.: 742,694

[22] Filed: Jun. 7, 1985

[51] Int. Cl.[4] ..... A63B 13/00

[52] U.S. Cl. ..... 272/123; 272/144; 297/377

[58] Field of Search ..... 272/134, 123, 144; 188/67; 297/377

[56] References Cited

U.S. PATENT DOCUMENTS

| | | | |
|---|---|---|---|
| 2,534,651 | 12/1950 | Abos et al. | 188/67 X |
| 2,588,174 | 3/1952 | Spielberg | 188/67 UX |
| 2,610,590 | 9/1952 | Van Campen | 188/67 X |
| 2,702,909 | 3/1955 | Atkins | 297/377 X |
| 2,707,108 | 4/1955 | Schotter | 188/67 X |
| 3,820,782 | 6/1974 | Salkeld | 272/134 X |
| 4,382,596 | 5/1983 | Silberman | 272/134 X |
| 4,396,191 | 8/1983 | Metler | 272/123 |
| 4,566,691 | 1/1986 | Mahnke | 272/144 X |

*Primary Examiner*—Richard J. Apley
*Assistant Examiner*—Robert W. Bahr
*Attorney, Agent, or Firm*—Harvey B. Jacobson

[57] ABSTRACT

An elongated support frame is provided including front and rear ends. The front end supports a seat portion therefrom for adjustable positioning therealong and the rear marginal portion of the seat portion swingably mounts the lower end of an inclined backrest portion therefrom for angular displacement about a horizontal axis extending transversely of the support frame. The upper end of an upstanding prop is pivotally anchored to the upper free swinging end of the backrest portion and anchor structure is mounted from the rear of the support frame for angular displacement relative thereto about a horizontal transverse axis. The anchor structure defines an upstanding sleeve through which the lower end of the prop is slidably received and the sleeve is spaced forward of the axis of rotation of the anchor structure relative to the frame. The sleeve includes internal cam-lock type gripping structure for frictionally gripping the prop against downward shifting of the latter relative to the sleeve but allowing free upward movement of the prop relative to the sleeve. In addition, the gripping structure includes a readily manually engageable release portion whereby the gripping action thereof on the prop may be released, when desired.

5 Claims, 8 Drawing Figures

48
44
42
46
28
2
32
36
38
34
40
36
72
44
46
46
30
66
10
58
16
54
24
18
14
60
12
2
56
50
20
22

48
42
46
28
74
70
66
86
32
76
78
80
72
92
40
3
34
36
38
4
58
65
54
68
24
64
60
4
52
3
56
50
52

WEIGHT LIFTING BENCH WITH ADJUSTABLE BENCH SECTIONS

BACKGROUND OF THE INVENTION 1. Field of the Invention

This invention relates to a weight lifting bench including a hingedly mounted backboard portion which may be adjusted in inclination. By inclining the backboard portion various different exercises may be accomplished in order to exercise different muscles. Further, an adjustable prop structure is utilized to retain the backboard portion in adjusted inclined position and the prop structure is readily releasable and re-adjustable in effective length.

2. Description of Related Art

Various different forms of props for seat back portions as well as other structures heretofore have been provided such as those disclosed in U.S. Pat. Nos. 2,703,690, 2,806,723, 2,815,788, 2,923,564, 3,374,011, 3,734,411 and 3,893,730. However, these previously known forms of props are not specifically designed for ease of release and re-adjustment of effective length while still incorporating a substantially fail safe mechanism to retain the associated prop in adjusted position.

SUMMARY OF THE INVENTION

The bench of the instant invention includes a pivotally mounted backrest portion incorporating an upstanding prop pivotally anchored at its upper end to the underside of the backrest portion and slidingly received through an upstanding passageway at its lower end equipped with longitudinally spaced gripping surfaces for gripping the prop. The passageway is defined through an anchor structure mounted to a stationary portion of the bench for angular displacement about a horizontal transverse axis and the aformentioned passageway is spaced laterally of one side of that axis and the gripping action of the aforementioned surfaces on the prop, as a result of a downward thrust thereon, tends to rotate the anchor structure about its axis of rotation in a direction increasing the gripping action of the gripping surfaces on the prop. Further, the gripping surfaces provided in the passageway and supported from the anchor structure are mounted in such a manner that an upward thrust on the prop will cause the anchor structure to rotate in the opposite direction about its axis of rotation and the gripping surfaces to at least substantially reduce their gripping action on the prop. In this manner, specific control over the gripping surfaces carried by the anchor structure is required only when it is desired to lower the prop relative to the passageway.

The main object of this invention is to provide an improved weight lifting bench including an angularly adjustable backrest portion.

Another object of this invention is to provide a weight lifting bench in accordance with the preceding object and wherein adjustment of the inclination of the backrest portion in order to increase its angulation relative to the horizontal may be effected merely by applying an upward force on the backrest portion.

Yet another object of this invention is to provide a backrest portion for a weight lifting bench and which is adjustable in angulation and includes adjusted angulation retaining structure in the form of frictional gripping means operative to increase the gripping action afforded thereby responsive to an increase of downward loading on the backrest portion.

Yet another object of this invention is to provide a weight lifting bench including a horizontal seat portion from which the backrest portion is pivotally mounted for angular adjustment and wherein the seat portion is adjustable longitudinally of the bench frame structure.

A final object of this invention to be specifically enumerated herein is to provide a weight lifting bench in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
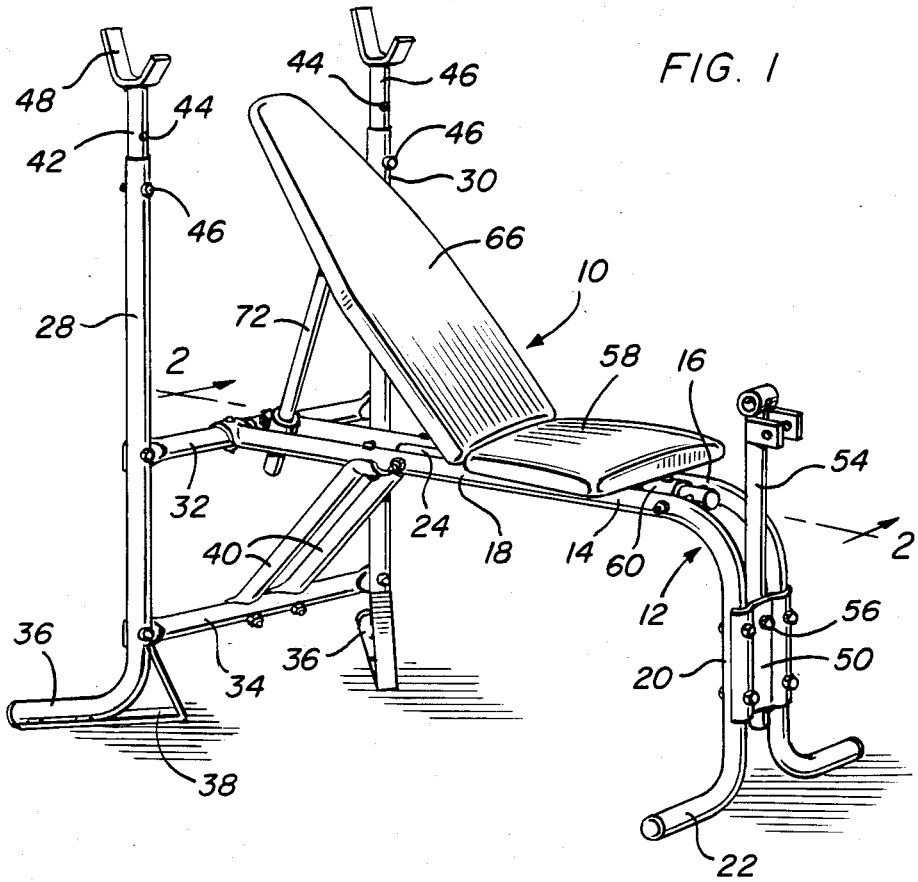
FIG. 1 is a perspective view of the weight lifting bench of the instant invention.

With reference now more specifically to the drawings the numeral 10 generally designates the weight lifting bench of the instant invention. The bench 10 includes a main frame referred to in general by the reference numeral 12 and incorporates a pair of opposite side mirror image longitudinal frame members 14 and 16. The frame members 14 and 16 each include a horizontal longitudinally extending portion 18 and a downwardly directed forward leg portion 20 terminating downwardly in a laterally outwardly projecting horizontal foot portion 22.

In addition, a central longitudinal portion 24 is supported between the portions 18 in spaced relation relative thereto through the utilization of a pair of through bolts 26 and a pair of spacing sleeves 27 disposed on each of the bolts 26 intermediate each of the longitudinal portions 18 and the central longitudinal portion 24.

The rear of the frame 12 includes a pair of opposite side upright standards 28 and 30 interconnected along their lower end portions by upper and lower transverse braces 32 and 34 extending and secured between the lower end portions of the standards 28 and 30. The lower terminal ends of the standards 28 and 30 include oppositely outwardly angled horizontal foot portions 36 and angled brace members 38 are secured between each foot portion 36 and the lower end of the corresponding standard.

The rear ends of the longitudinally extending portions 18 are secured to the mid-portion of the upper transverse brace 32 at points spaced longitudinally therealong and a pair of inclined braces 40 are secured between the lower transverse brace member 34 and the longitudinally extending portions 18 at points spaced therealong forward of the upper transverse brace portion 32.

The standards 28 and 30 are tubular and include registered front-to-rear extending bores (not shown) formed in the upper ends thereof. The standard upper ends telescopingly receive the lower end portions of vertical support members 42 provided with vertically spaced front-to-rear extending bores 44 and the bores 44 are registrable with the bores (not shown) formed in the upper ends of the standards 28 and removable pins 46 may be passed through the registered bores in order to maintain the vertical support members 42 in adjusted shifted positions relative to the upper ends of the standards 28 and 30, the upper ends of the support members 42 including upwardly opening cradle portions 48 for supporting the opposite end portions of a weight bar therefrom.

A formed vertically disposed brace 50 embracingly engages and extends between the leg portions 20 and is secured to the latter through the utilization of through bolts 52. In addition, the lower end portion of a leg exercising attachment support 54 is secured to the mid-portion of the brace 50 between the leg portions 20 by bolts 56 secured through the brace 50 and the support 54.

A horizontal seat portion 58 is provided and includes a front-to-rear extending mounting sleeve 60 supported from the underside thereof. The mounting sleeve 60 is slidingly disposed on the center longitudinal portion 24 and includes a pair of registered upper and lower diametric bores 62 which in turn may be registered with longitudinally spaced pairs of upper and lower bores 64 formed in the center longitudinal portion 24 and a removable pin 65 may be used to retain the sleeve 60 in adjusted shifted position along the central longitudinal portion 24.

The rear marginal portion of the seat portion 58 has the lower end of an inclined backrest portion 66 hingedly supported therefrom by a hinge assembly 68 and an intermediate height portion of the backrest portion 66 includes a mounting bracket 70 defining a pair of laterally spaced apart mounting flanges between which the upper end of a cylindrical prop 72 is pivotally mounted by a pivot fastener 74.

The longitudinal mid-portion of the transverse brace 32 has an anchor assembly referred to in general by the reference numeral 76 mounted therefrom. The anchor assembly 76 includes a first sleeve portion 78 rotatable on the transverse brace 32 between the rear ends of the longitudinally extending portions 18 and a second sleeve portion 80 supported from and disposed at right angles relative to the first sleeve portion 78. The second sleeve portion 80 defines a longitudinal passage 82 extending therethrough in which the lower end portion of the prop 72 is slidably received. The sleeve portion 80 includes a rear window 84 formed therein through which outwardly extending tab portions 86 of a plurality of gripping washers 88 are loosely received and the front side of the sleeve portion 80 has a vertical slot 90 formed therein through which corresponding forwardly projecting tabs or tab portions 92 carried by the washers 88 are slidingly received. The washers 88 are loosely received in the sleeve portion 80 through a forwardly opening and circumferentially extending slot 94 formed in the sleeve portion 80 and into which the upper end of the slot 90 opens. The upper end of the sleeve portion 80 includes a partial annular top wall 96 and a compression spring 98 is disposed about the prop 72 between the underside of the top wall 96 and the uppermost washer 88. Thus, the spring 98 tends to yieldingly bias the washers 88 to the positions thereof illustrated in FIG. 7 with the lowermost tab portion 92 positioned close to the bottom end of the slot 94, in which positions the opposing forward and rearward inner peripheral portions of the washers 88 frictionally grip the prop 72, in order to prevent its downward shifting relative to the sleeve portion 80. However, the lowermost tab portion 92 may be upwardly displaced, see FIG. 7, in order to release the gripping action of the washers 88 on the prop 72 and thereby enable free downward shifting of the prop 72 through the passage 82.

Figure 2:
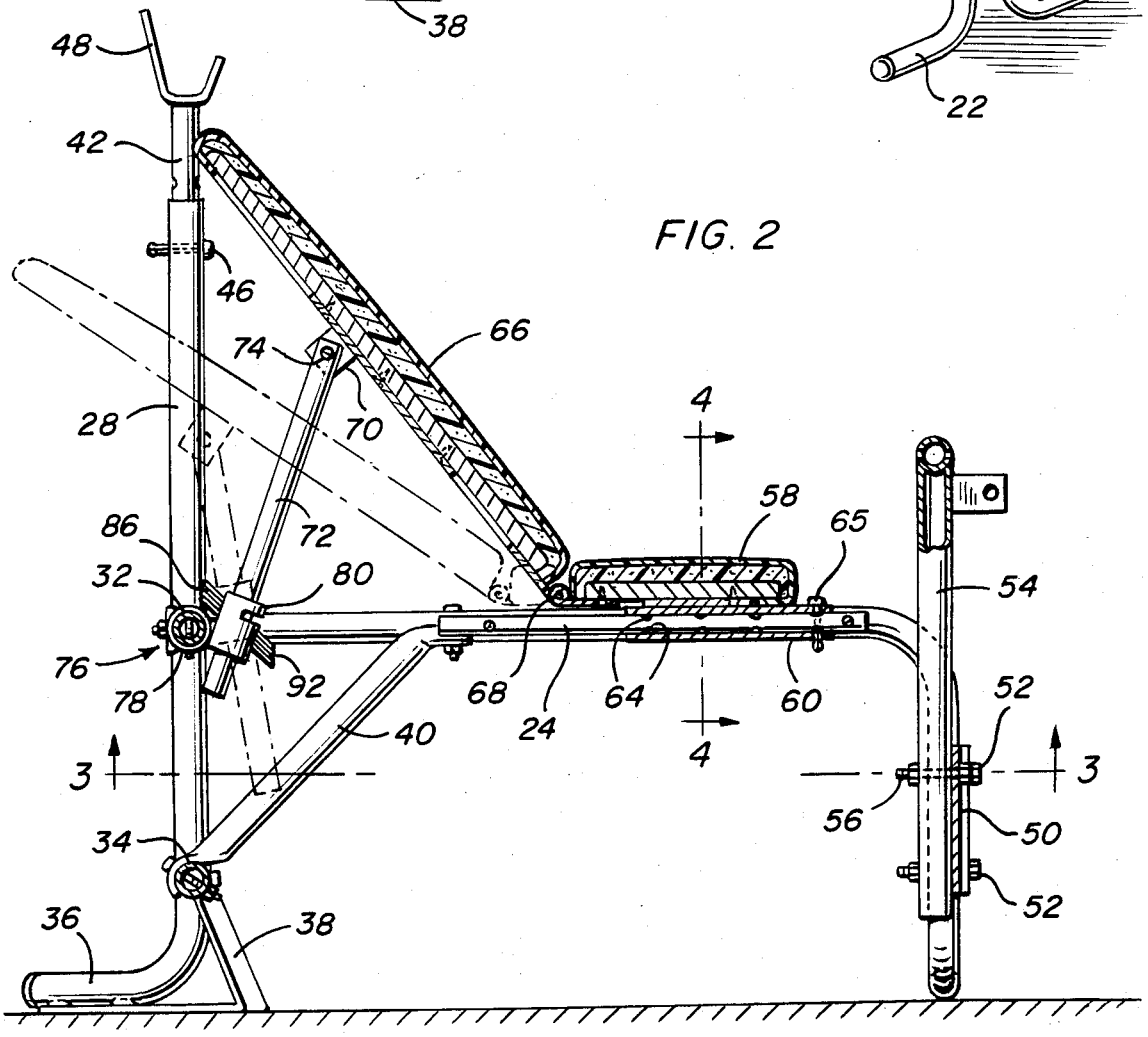
FIG. 2 is an enlarged longitudinal vertical sectional view taken substantially upon the plane indicated by the section line 2—2 of FIG. 1.
Figure 3:
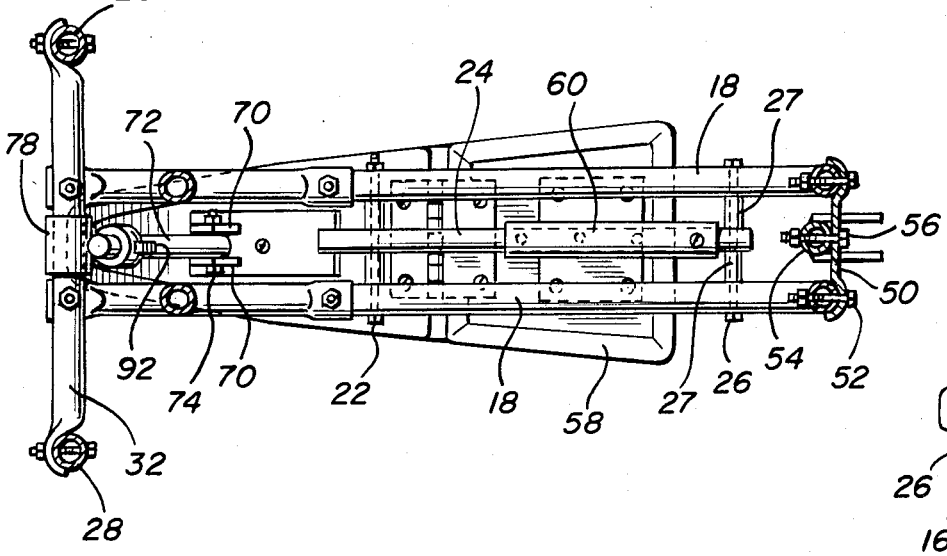
FIG. 3 is a horizontal sectional view taken substantially upon the plane indicated by the section line 3—3 of FIG. 2.
Figure 4:
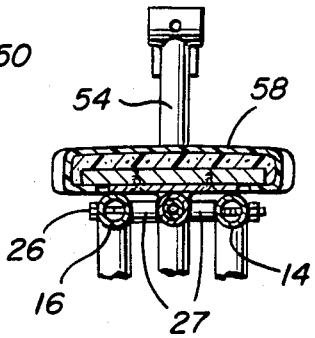
FIG. 4 is a fragmentary vertical sectional view taken substantially upon the plane indicated by the section line 4—4 of FIG. 2.
Figure 5:
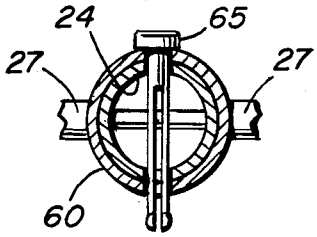
FIG. 5 is a fragmentary enlarged vertical sectional view illustrating the structure by which the seat portion of the bench may be shifted longitudinally of the frame thereof and retained in adjusted position.
Figure 7:
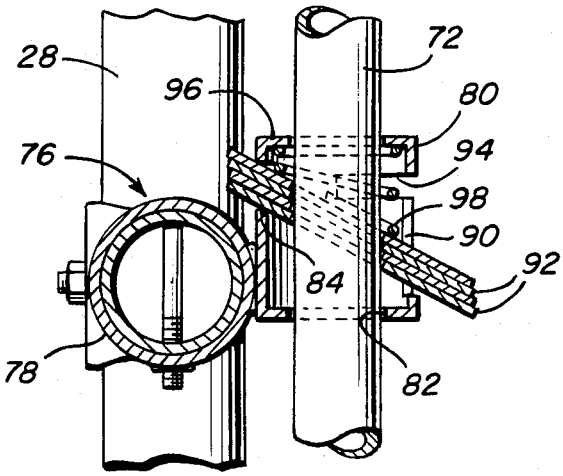
FIG. 7 is an enlarged fragmentary vertical sectional view taken substantially upon the plane indicated by the section line 7—7 of FIG. 6.
Figure 6:
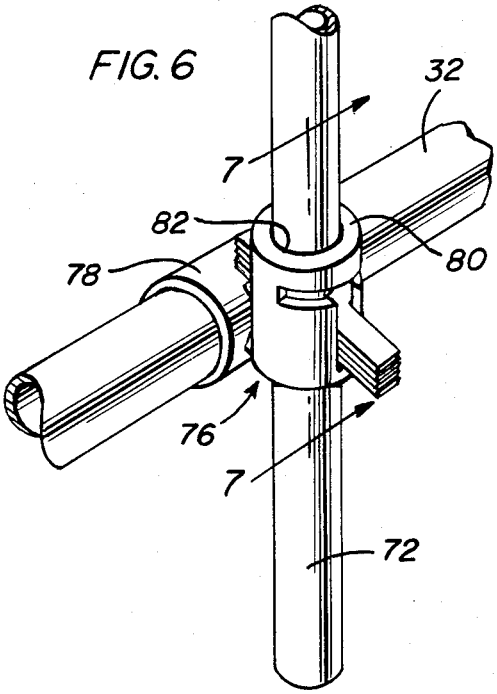
FIG. 6 is a fragmentary perspective view illustrating the prop of the backrest portion of the invention and the structure by which the effective length of the prop may be adjusted.
Figure 8:
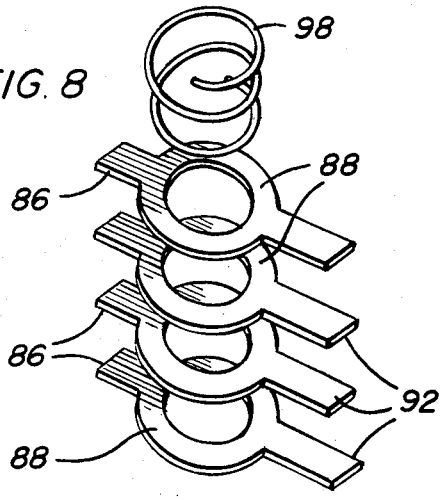
FIG. 8 is an exploded perspective view of the gripping elements by which the prop may be anchored in adjusted shifted position relative to the frame of the bench.

From a comparison of FIGS. 1 and 2 of the drawings it will be appreciated that minimal frictional engagement between the washers 88 and the prop 72 as a result of the weight of the backrest portion 66 bearing downwardly on the prop 72 the anchor assembly 76 will tend to rotate in a clockwise direction as viewed in FIGS. 2 and 7 of the drawings. This of course will cause the front and rear inner peripheral portions of the washers 88 to even more tightly grip the prop 72 to prevent its downward shifting relative to the anchor assembly 76. Further, as downward loading on the prop 72 is increased, the gripping action of the washers 88 on the prop 72 will be even further increased.

On the other hand, if it is desired to increase the angulation of the backrest portion 66, it is merely necessary to exert an upward pull on the backrest portion 66 which in turn results in an upward pull on the prop 72. This, in conjunction with minimal frictional engagement between the washers 88 and the prop 72, will cause the anchor assembly 76 to tend to rotate in a counterclockwise direction as viewed in FIGS. 2 and 7 of the drawings thereby almost completely releasing the frictional engagement of the front and rear inner peripheries of the washers 88 on the prop 72. It may therefore be seen that in order to increase the angulation of the backrest portion 66 relative to the horizontal it is not necessary to manually upwardly displace the tab portions 92, but merely necessary to effect an upward force on the free swinging end of the backrest portion 66. If at any time it is desired to lower the backrest portion 66, however, the tab portions 92 must be upwardly displaced in order to allow downward movement of the prop 72 relative to the anchor assembly 76.

Because the seat portion 58 is adjustable longitudinally of the bench 10 the "shoulder area" of a person using the bench 10 may be positioned in the plane of the standards 28 and 30 throughout adjustment changes in the inclination of the backrest portion 66, thereby enabling the user to "press" a maximum amount of weight.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A weight lifting bench including an elongated horizontal frame having front and rear ends, an elongated backrest portion including base and free ends, a seat portion mounted from said frame for guided adjustable shifting along the front end thereof and including front and rear marginal portions, means operative to releasably lock said seat portion in adjusted shifted positions along said frame, means pivotally mounting said base end from said rear marginal portion for angular displacement of said backrest portion relative to said frame about a first horizontal transverse axis with the free end of said backrest portion swingable between a raised position spaced appreciably above said rear end of said frame and a lowered position closely overlying the rear end of said frame, anchor structure, means pivotally mounting said anchor structure from said rear end of said frame for rotation about a second horizontal transverse axis and including a portion thereof defining an elongated upstanding guide passage extending therethrough and spaced at least slightly longitudinally of said frame relative to the last mentioned axis, an upstanding prop, the upper end of said prop being pivotally mounted from said free end of said backrest portion for angular displacement relative thereto about a third horizontal transverse axis, the lower end of said prop being guidably received through said passage, said anchor structure portion including manually releasable cam lock means operative to releasably frictionally grip said prop with a one-way movement preventing engagement therewith to prevent downward movement of said prop relative to said anchor structure portion and allow reasonably free upward movement of said prop relative thereto, the rear end of said frame including a pair of upstanding and upwardly projecting opposite side standards supported therefrom whose upper ends include means defining upwardly opening cradles to seatingly receive the opposite end of a weight bar extending transversely of said frame therein, the pivotal connection of said backrest portion with said seat portion, the adjustability of said seat portion longitudinally of the front end of said frame and the adjustablility of said prop enabling a predetermined portion of said backrest portion, spaced therealong from said first axis and disposed in a vertical plane containing the shoulders of a user of said bench having his upper torso resting upon said backrest portion, to be disposed in substantially the same vertical plane as said cradles to thereby properly position the user's shoulders directly beneath a weight bar supported from said cradles.

2. In combination with an elongated horizontal mount including first and second ends, an elongated member having first and second ends, mounting means pivotally mounting said first end of said elongated member from said first end of said mount for angular displacement of said elongated member from said first end of said mount for angular displacement of said elongated member relative to said mount about a first axis traverse to said mount and elongated member between a first inclined position with said second end of said elongated member spaced appreciably above said mount and a second position with said second end of said elongated member swung downward toward said second end of said mount and more closely spaced therefrom, an elongated inclined prop including an upper end pivotally mounted from said second end of said elongated member for angular displacement relative thereto about a second axis transverse to said prop and elongated member an anchor structure, means pivotally mounting said anchor structure from said second end of said mount for oscillation relative thereto about a third axis paralleling said first and second axes, said anchor structure including a portion thereof defining an elongated guide passage disposed transverse to said third axis and closely laterally spaced from the latter in a first direction extending longitudinally of said mount, the end of said prop remote from said one end being slidingly and guidingly received through said guide passage, said anchor structure including manually releasable cam lock means operative to releasably frictionally grip said prop with a one-way movement preventing frictional engagement therewith to prevent downward movement of said prop relative to said anchor structure, said cam lock means including means operative to increase the frictional grip exerted thereby on said prop responsive to angular displacement of said anchor structure relative to said second end of said mount as a result of a downward thrust being applied to said prop, a second member slidably mounted on said mount for adjustable shifting longitudinally therealong, said second member including opposite first and second marginal portions facing toward said first and second elongated mount ends, respectively, said first end of said elongated member being pivotally mounted from said second end of said second member, lock means releasably locking said second member in adjusted shifted position on said mount, said second end of said mount including a pair of upstanding and upwardly projecting opposite side standards supported therefrom whose upper ends include means defining upwardly opening cradles to seatingly receive the opposite ends of a weight bar extending transversely of said mount therein.

3. A weight lifting bench including an elongated horizontal frame having front and rear ends, an elongated backrest portion including base and free ends, means pivotally mounting said base end from said frame intermediate the front and rear ends thereof for angular displacement of said backrest portion relative to said frame about a horizontal transverse axis and with said free end of said backrest portion swingable toward and away from the rear end of said frame, anchor structure, means pivotally mounting said anchor structure from said rear end of said frame for rotation about a horizontal transverse axis and including a portion thereof defining an elongated upstanding guide passage extending therethrough, said portion being disposed immediately forward of the last mentioned axis, an upstanding prop, the upper end of said prop being pivotally mounted from the free end of said backrest portion for angular displacement relative thereto about a horizontal transverse axis, the lower end of said prop being guidingly received through said passage, said anchor structure including manually releasable cam lock means operative to releasably frictionally grip said prop with a one-way movement preventing engagement therewith to prevent downward movement of said prop relative to said anchor structure and allow reasonably free upward movement of said prop relative to said anchor structure, said cam lock means including means operative to increase the frictional grip exerted thereby on said prop to prevent downward movement of said prop relative to said anchor structure responsive to a thrust being applied to said portion in a downward direction to effect angular displacement of said anchor structure about said axis, said portion including an upstanding sleeve structure defining said passage and a washer stack disposed within said passage, the lower end of said prop being slidably received through said washer stack, means establishing a fulcrum point for the washers of said stack on the rear side of said passage and establishing limits of up and down movement of the forward sides of said washers about said fulcrum point, said washers comprising said cam lock means, said means establishing a fulcrum including a window formed in the rear side of said sleeve structure and a rear tab portion on at least the lower washer of said stack projecting through said window and supported from the marginal portion of said sleeve structure defining the lower margin of said window, the front side of said sleeve having a longitudinal slot formed therein, and a front tab portion on at least the lower washer of said stack projecting through and slidable in said slot.

4. The weight lifting bench of claim 3 including spring means in said sleeve structure yieldingly downwardly biasing the front and rear portions of the upper washer of said stack.

5. The weight lifting bench of claim 3 wherein said elongated horizontal frame includes a pair of laterally spaced apart longitudinally extending opposite side members, a central longitudinal portion supported at its opposite ends between said opposite side members in laterally spaced relation relative thereto, a seat portion, said seat portion including an underlying front-to-rear extending sleeve supported therefrom slidable on said central longitudinal portion, means co-acting with said seat portion supported sleeve and said central longitudinal portion operative to releasably retain the seat portion supported sleeve in adjusted shifted position along said central longitudinal portion, the base end of said backrest being pivotally mounted from the rear marginal portion of said seat portion.

* * * * *